US009200642B2

(12) United States Patent
Nowitzki et al.

(10) Patent No.: US 9,200,642 B2
(45) **Date of Patent: *Dec. 1, 2015**

(54) ABRASIVE HANDLING SUBMERSIBLE PUMP ASSEMBLY DIFFUSER

(71) Applicant: Summit ESP, LLC, Tulsa, OK (US)

(72) Inventors: Wesley John Nowitzki, Broken Arrow, OK (US); Gregory Austin Davis, Broken Arrow, OK (US); Steven Andrew Lovell, Tulsa, OK (US); John Vanderstaay Kenner, Houston, TX (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/682,794

(22) Filed: Apr. 9, 2015

(65) Prior Publication Data

US 2015/0211547 A1 Jul. 30, 2015

Related U.S. Application Data

(63) Continuation of application No. 14/550,333, filed on Nov. 21, 2014, now Pat. No. 9,039,356.

(60) Provisional application No. 61/908,638, filed on Nov. 25, 2013.

(51) Int. Cl.

| | |
|---|---|
| ***F04D 29/54*** | (2006.01) |
| ***F04D 7/04*** | (2006.01) |
| ***F04D 1/06*** | (2006.01) |

(52) U.S. Cl.

CPC ..... *F04D 29/548* (2013.01); *F04D 1/06* (2013.01); *F04D 7/04* (2013.01)

(58) Field of Classification Search

CPC ..... F04D 29/54; F04D 29/548; F04D 29/566; F04D 13/08; F04D 13/083; F04D 13/10; F04D 29/445; F04D 7/045; F04D 29/708

USPC ..... 415/182.1, 198.1, 199.1, 199.2, 199.3, 415/121.2, 169.1, 219.1, 224, 224.5; 417/423.3

See application file for complete search history.

(56) References Cited

U.S. PATENT DOCUMENTS

| | | | | |
|---|---|---|---|---|
| 2,066,505 | A * | 1/1937 | Wolfe | 415/121.2 |
| 2,236,953 | A * | 4/1941 | Schott | 415/182.1 |
| 4,511,307 | A * | 4/1985 | Drake | 415/170.1 |
| 5,160,240 | A * | 11/1992 | Wilson | 415/170.1 |
| 5,722,812 | A * | 3/1998 | Knox et al. | 415/199.1 |
| 6,106,224 | A * | 8/2000 | Sheth et al. | 415/104 |
| 7,648,332 | B2 * | 1/2010 | Eslinger et al. | 415/106 |
| 7,841,826 | B1 * | 11/2010 | Phillips | 415/121.1 |

* cited by examiner

*Primary Examiner* — Nathaniel Wiehe
*Assistant Examiner* — Eldon Brockman
(74) *Attorney, Agent, or Firm* — Frederic Dorwart, Lawyers; Penina Michlin Chiu

(57) ABSTRACT

An abrasive handling submersible pump assembly diffuser is described. An electric submersible pump assembly stage comprises a rotatable impeller, and a co-axially mounted diffuser comprising a diffuser bowl, the diffuser bowl comprising a plurality of diffuser bowl wedges having a blunted pie-shape, each of the plurality of diffuser bowl wedges protruding axially from a diffuser bowl floor into a cavity between the rotatable impeller and the co-axially mounted diffuser such that each of the plurality of diffuser bowl wedges protrudes into a path of pumped solid-laden fluid, wherein the blunted pie-shaped wedges extend radially between an inner wall and an outer wall of the diffuser bowl and a thickness of the blunted pie-shaped wedges in a circumferential direction increases towards the outer wall.

25 Claims, 11 Drawing Sheets

ABRASIVE HANDLING SUBMERSIBLE PUMP ASSEMBLY DIFFUSER

CROSS REFERENCE TO RELATED APPLICATIONS

The present application is a continuation of U.S. application Ser. No. 14/550,333 to Nowitzki et al. filed Nov. 21, 2014 and entitled "ABRASIVE HANDLING SUBMERSIBLE PUMP ASSEMBLY DIFFUSER," which claims the benefit of U.S. Provisional Application No. 61/908,638 to Nowitzki et al., filed Nov. 25, 2013 and entitled "SYSTEM, APPARATUS AND METHOD FOR A SUBMERSIBLE PUMP DIFFUSER FOR USE IN ABRASIVE ENVIRONMENTS," which are each hereby incorporated by reference in their entireties.

BACKGROUND OF THE INVENTION

1. Field of the Invention

Embodiments of the invention described herein pertain to the field of submersible pump assemblies. More particularly, but not by way of limitation, one or more embodiments of the invention enable an abrasive handling submersible pump assembly diffuser.

2. Description of the Related Art

Submersible pump assemblies are used to artificially lift fluid to the surface in deep wells such as oil, water or gas wells. A typical electric submersible pump (ESP) assembly consists of an electrical motor, seal section, pump intake and centrifugal pump, which are all connected together with shafts. In gassy wells, charge pumps or gas separators are sometimes included into the assembly to improve gas handling capability. The electrical motor supplies torque to the shafts, which provides power to the centrifugal pump. Centrifugal pumps impart energy to a fluid by accelerating the fluid through a rotating impeller paired with a stationary diffuser. Multiple stages of impeller and diffuser pairs may be used to further increase the pressure and lift fluid to the surface of a well. Each impeller rotates within the diffuser to which it is paired. The diffuser does not rotate, but is mounted co-axially with the impeller and nests on the diffuser of the previous stage. FIG. 1 illustrates conventional stacked impeller and diffuser stages.

One challenge to economic and efficient ESP operation is pumping solid-bearing fluid, which can quickly cause abrasive and erosive wear on pump assembly components. In one example, oil and gas which are pumped from deep wells (up to about 12,000 feet deep) often contain sand, dirt, iron sulfide (FeS) and other abrasive contaminants (collectively or individually "media"). Pumps for these purposes have tight clearances and high rotational speeds, and are therefore highly susceptible to abrasive and erosive wear. Pump diffusers in particular are highly susceptible to abrasives. As solid laden fluid rotates through the centrifugal pump, apparent centrifugal forces push media against the walls of the diffusers causing "swirling" against the walls and floor. The swirling erodes the diffusers causing premature failure.

The smooth areas of diffusers predominantly affected by swirling are on the inlet and discharge side of the diffuser in the cavities created between the impeller and diffuser. These conventional cavities are illustrated in FIG. 1, which show conventional cavities 100. In this example, when operating in media bearing fluid, media will erode the floor of the conventional diffuser bowl near the bowl outer wall, as well as the bowl outer wall itself. In some instances, media erodes through the diffuser walls entirely and proceeds to erode through the pump housing surrounding the pump assembly. A pump with eroded hole(s) in its housing will typically have significantly reduced or no fluid production capability, an increased risk of motor overheating due to reduced fluid in the flow path, and in extreme circumstances, may cause a parting pump.

Recently attempts have been made to combat abrasive wear to pump components by adding anti-swirl ribs, called "sand dams" to the bowl of the diffusers. Sand dams create a perpendicular raised feature extruding into a conventional cavity between the impeller and diffuser. Sand dams attempt to direct media in the well fluid away from the diffuser walls where it would otherwise cause damage. A conventional diffuser with conventional sand dams is illustrated in FIG. 2. As shown in FIG. 2, conventional diffuser 200 includes rectangular conventional sand dams 205 extruding perpendicularly into the conventional diffuser bowl. However, conventional sand dams do not adequately counteract swirling. Grooves 210 in conventional diffuser wall 215 form due to contact with abrasives despite the presence of conventional sand dam 205. In addition, edges of conventional sand dam 205 where the sand dams 205 meets the diffuser wall 215 will continue to erode until worn through entirely. FIG. 3 illustrates the way in which a conventional sand dam 205 may influence the flow of media in produced well fluid. As shown in FIG. 3, abrasives in the fluid continue to gravitate towards the diffuser wall and cause wear to the conventional sand dam as well as the diffuser wall and floor—as conventional sand dams may cause abrasives to bounce between the wall and the sand dam. Although a conventional sand dam may increase the operational life of a diffuser, documented run times of diffusers with conventional sand dams are still unacceptably short, since once a diffuser has eroded it must be replaced. Replacing a diffuser means removing the submersible pump assembly from the well, which is costly and time consuming.

It would be an advantage for diffusers operating in abrasive environments to have an increased lifespan without excessive erosion. Therefore, there is a need for an abrasive handling submersible pump assembly diffuser.

BRIEF SUMMARY OF THE INVENTION

An abrasive handling submersible pump assembly diffuser is described. An illustrative embodiment of a submersible pump assembly diffuser comprises an upthrust bowl separated from a downthrust bowl by a diffuser vane, wherein each of the upthrust bowl and the downthrust bowl comprise a floor, an inner wall extending axially from the floor around an inner diameter and an outer wall extending axially from the floor around an outer diameter, a first plurality of pie-shaped wedges arranged about the upthrust bowl floor, each of the first plurality of pie-shaped wedges protruding axially from the upthrust bowl floor and extending radially between the inner wall and the outer wall of the upthrust bowl, wherein a circumferential thickness of each of the first plurality of pie-shaped wedges increases from the inner wall to the outer wall of the upthrust bowl, and a second plurality of pie-shaped wedges arranged about the downthrust bowl floor, each of the second plurality of pie-shaped wedges protruding axially from the downthrust bowl floor and extending radially between the inner wall and the outer wall of the downthrust bowl, wherein a circumferential thickness of each of the second plurality of pie-shaped wedges increases from the inner wall to the outer wall of the downthrust bowl. In some embodiments, a side of each of the first plurality of pie-shaped wedges facing the inner wall of the upthrust bowl is blunted, and a side of each of the second plurality of pie-shaped wedge facing the inner wall of the downthrust bowl is blunted. In certain embodiments, at least one of the second plurality of pie-shaped wedges comprises a sector-shaped roof. In some embodiments, the roof is inclined towards the outer wall of the downthrust bowl as judged from the inner wall of the downthrust bowl. In certain embodiments, the roof comprises a notch in height. In some embodiments, there are four pie-shaped wedges in the first plurality of pie-shaped wedges evenly spaced about the upthrust bowl floor, and there are four pie-shaped wedges in the second plurality of pie-shaped wedges evenly spaced about the downthrust bowl floor.

An illustrative embodiment of a submersible pump assembly diffuser comprises a concave diffuser bowl comprising a floor, an inner wall extending axially about an inner diameter of the floor, an outer wall extending axially about an outer diameter of the floor, and a plurality of blunted pie-shaped wedges arranged about the floor of the concave bowl, each of the plurality of blunted pie-shaped wedges protruding axially from the floor and extending radially between the inner wall and the outer wall, wherein a thickness of each of the plurality of blunted pie-shaped wedge measured in a circumferential direction increases from the inner wall to the outer wall, and wherein a blunted side of each of the plurality of blunted pie-shaped wedges faces the inner wall. In some embodiments, the concave bowl is an upthrust bowl. In certain embodiments, the concave bowl is a downthrust bowl. In some embodiments, each of the plurality of blunted pie shaped wedges comprises two radial sides separated by about a forty-five degree angle. In certain embodiments, the diffuser bowl is in a stage of one of an electric submersible pump assembly gas separator, an electric submersible pump assembly charge pump or a centrifugal pump of an electric submersible pump assembly.

An illustrative embodiment of an electric submersible pump assembly stage comprises a rotatable impeller, and a co-axially mounted diffuser comprising a diffuser bowl comprising a plurality of diffuser bowl wedges having a blunted pie-shape, each of the plurality of diffuser bowl wedges protruding axially from a diffuser bowl floor into a cavity between the rotatable impeller and the co-axially mounted diffuser such that each of the plurality of diffuser bowl wedges protrudes into a path of pumped solid-laden fluid, wherein each of the plurality of the blunted pie-shaped wedges extends radially between an inner wall and an outer wall of the diffuser bowl and a thickness in a circumferential direction of each of the plurality of the blunted pie-shaped wedges increases towards the outer wall. In some embodiments, a top side of at least one of the plurality of diffuser bowl wedges forms an inclined roof as judged from the inner wall, and the inclined roof comprises a chamfer on a leading edge. In some embodiments, the inclined roof comprises a funneled incision on a leading edge. In certain embodiments, the inclined roof comprises a notch in axial height. In certain embodiments, the cavity is on an inlet side of the co-axially mounted diffuser. In certain embodiments, the cavity is on a discharge side of the co-axially mounted diffuser.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
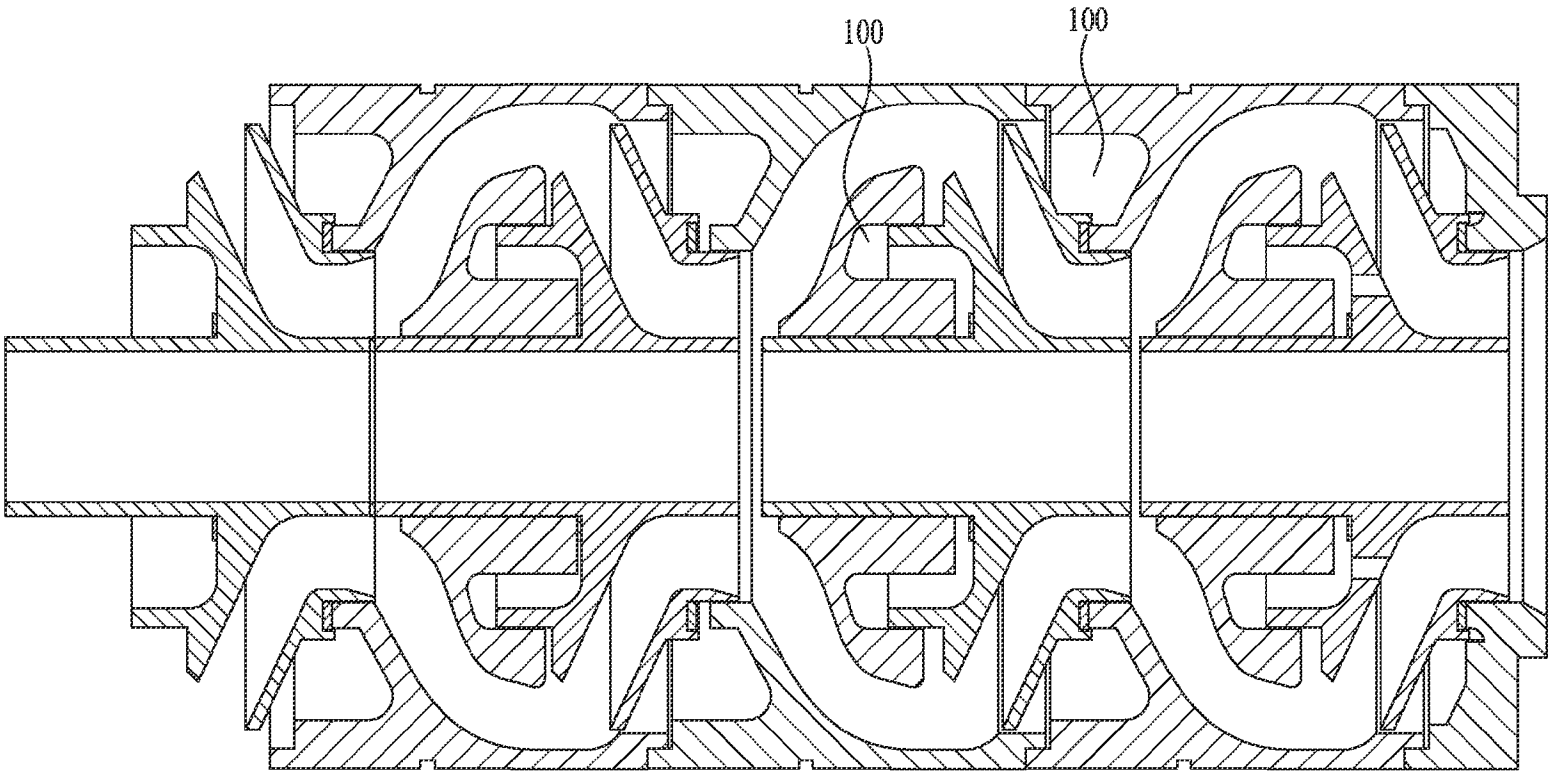
FIG. 1 PRIOR ART
FIG. 1 illustrates a cross sectional view of conventional impeller and diffuser stages of the prior art.
Figure 2:
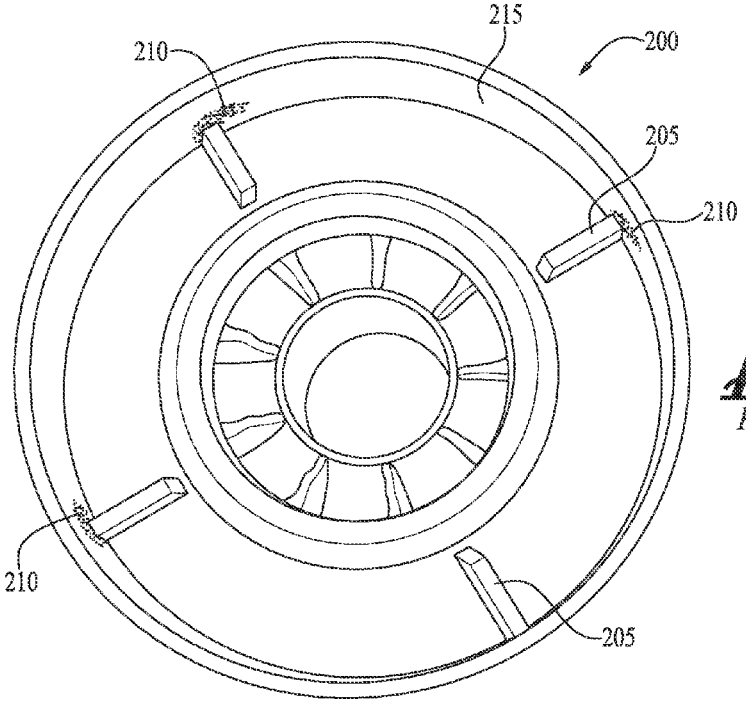
FIG. 2 PRIOR ART
FIG. 2 is a perspective view of a conventional diffuser of the prior art.
Figure 3:
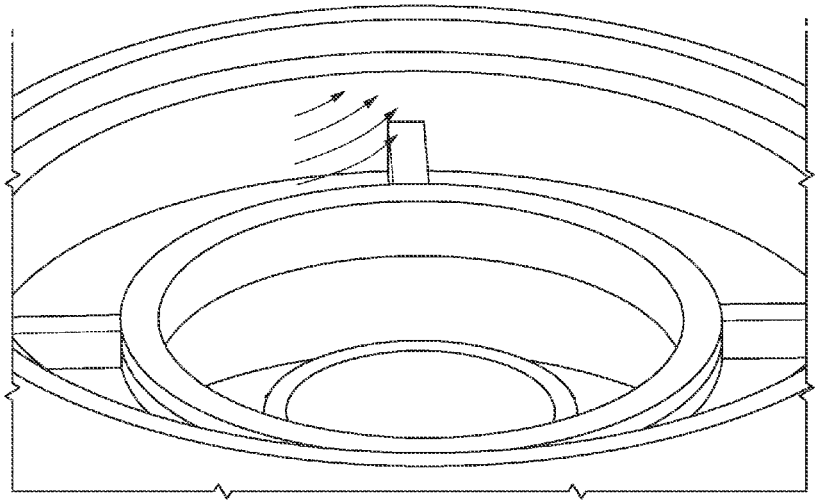
FIG. 3 PRIOR ART
FIG. 3 is a schematic illustrating the flow of media through a diffuser of the prior art with conventional sand dams.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An abrasive handling submersible pump assembly diffuser for use in abrasive environments will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a wedge may also refer to multiple wedges.

As used in this specification and the appended claims, the terms "media", "solids", "laden well fluid," "abrasives" and "contaminants" refer interchangeably to sand, dirt, rocks, rock particles, soils, slurries, and any other non-liquid, non-gaseous matter found in the fluid being pumped by an electric submersible pump assembly.

As used in this specification and the appended claims, the terms "inner" and "inwards" with respect to a diffuser or other pump assembly component refer to the radial direction towards the center of the shaft of the pump assembly and/or the hub of a diffuser, as applicable.

As used in this specification and the appended claims, the terms "outer" and "outwards" with respect to a diffuser or other pump assembly component refer to the radial direction away from the center of the shaft of the pump assembly and/or the hub of a diffuser, as applicable.

As used in this specification and the appended claims, the term "bottom" with respect to a diffuser or other pump assembly component refers to an upstream side of the component.

As used in this specification and the appended claims, the term "top" with respect to a diffuser or other pump assembly component refers to a downstream side of the component.

"Coupled" refers to either a direct connection or an indirect connection (e.g., at least one intervening connection) between one or more objects or components. The phrase "directly attached" means a direct connection between objects or components.

"Downstream" refers to the direction substantially with the primary flow of fluid when the centrifugal pump is in operation. Thus by way of example and without limitation, in a vertical downhole electric submersible pump assembly, the downstream direction may be towards the surface of the well.

"Upstream" refers to the direction substantially opposite the primary flow of fluid when the centrifugal pump is in operation. Thus by way of example and without limitation, in a vertical downhole electric submersible pump assembly, the upstream direction may be towards the center of the earth and/or the bottom of the well.

"Downthrust" refers to the force as a result of a portion of the impeller discharge pressure acting on the area of the top impeller shroud. The top of a diffuser may experience downthrust and thus be referred to herein as the "downthrust side" of a diffuser.

"Upthrust" refers to discharge pressure acting against the bottom shroud of the impeller and/or the force produced by the momentum of pumped fluid making its turn in the impeller passageway. The bottom of a diffuser may experience upthrust and thus be referred to herein as the "upthrust side" of a diffuser.

As used in this specification and the appended claims, the term "roof" means the uppermost surface of a wedge in a downthrust bowl, or the lowermost surface of a wedge in an upthrust bowl.

Illustrative embodiments of the invention described herein may reduce abrasion caused by media laden well fluid on the outer wall and floor of a diffuser bowl of an electric submersible pump (ESP) assembly, and may allow the pump assembly to handle higher concentrations of media in produced well fluid. The diffuser of illustrative embodiments may improve over conventional diffusers by functioning over a longer period of time without operation-prohibitive erosion. Illustrative embodiments may extend the run life of a centrifugal pump, charge pump and/or high volume gas separator of an ESP assembly by reducing the tendency of media to swirl against the walls and/or floor of diffusers incorporated into those ESP assembly components.

One or more illustrative embodiments include pie-shaped wedges circumferentially disposed about an upthrust diffuser bowl, a downthrust diffuser bowl or both. Each wedge may protrude axially from the floor of a diffuser bowl into a cavity between the impeller and diffuser on the inlet and/or discharge side of the diffuser, and extend radially between an inner wall and an outer wall of the diffuser bowl. The thickness of each pie-shaped wedge may increase in a circumferential direction towards the outer wall of the bowl. In some embodiments, the circumferential thickness of a wedge (the thickness measured in a circumferential direction) may increase linearly from the inner wall towards the outer wall such that the roof of a wedge forms the shape of a sector of a circle. For example, the pie-shaped wedge may be a sextant or octant shape when viewed from above. The side of the wedge facing the inner diameter and/or inner wall of the bowl may be blunted.

The wedges of the invention may cause media, which would otherwise tend to swirl against the outer wall and floor of a diffuser bowl—due to the apparent centrifugal force of the pump when in operation—to instead deflect away from the wall and/or floor of a diffuser bowl. The wedges of illustrative embodiments may provide a thicker barrier to media at the outer diameter of the diffuser bowl as compared to the inner diameter of the bowl. The wedges of illustrative embodiments may cause media to deflect away from the diffuser bowl wall and diffuser bowl floor, and instead travel towards the primary flow path of produced fluid. While the invention is described in terms of an ESP application for pumping oil or gas, nothing herein is intended to limit the invention to those embodiments.

Diffuser Bowls

Figure 4:
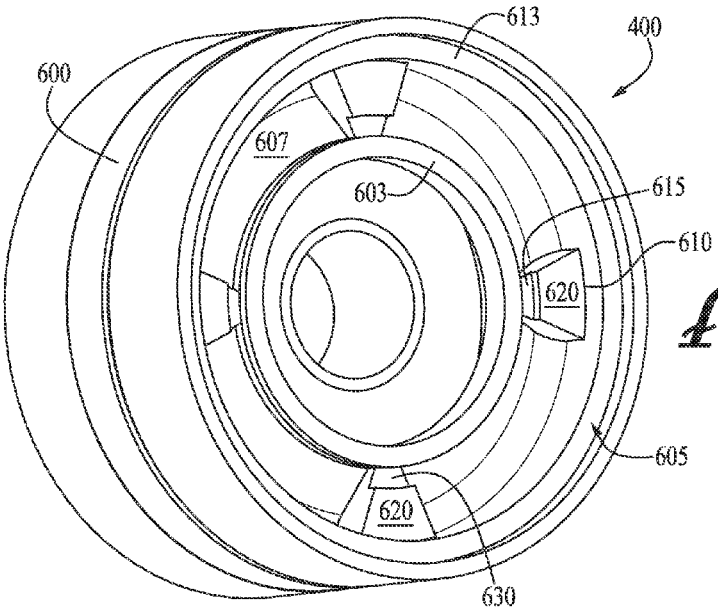
FIG. 4 is a perspective view of a downthrust side of a diffuser of an illustrative embodiment.
Figure 5:
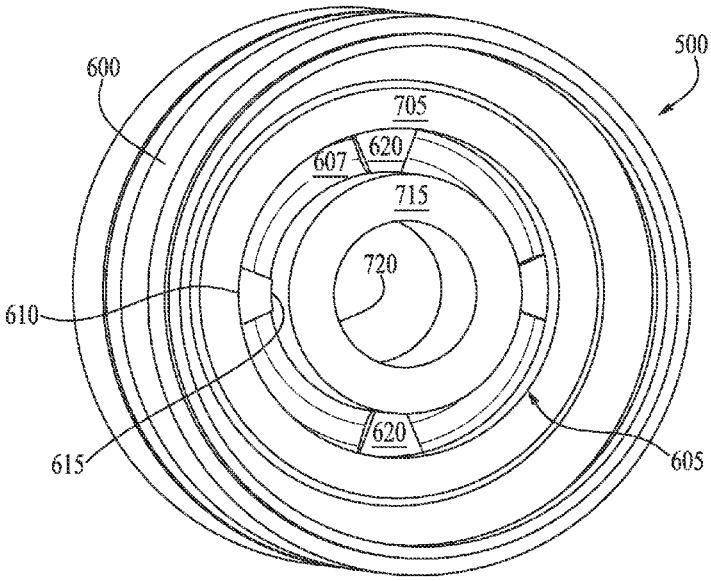
FIG. 5 is a perspective view of an upthrust side of a diffuser of an illustrative embodiment.

FIG. 4 is an exemplary downthrust side of a diffuser of illustrative embodiments, and FIG. 5 is an exemplary upthrust side of a diffuser of illustrative embodiments. As shown in FIGS. 4 and 5, diffuser 600 includes bowl 605 on an upthrust side 500 and bowl 605 on downthrust side 400, and each bowl 605 may be similar in shape to a Bundt pan. Bowl 605 on downthrust side 400 may be oriented in an ESP assembly in a concave upward direction, such that bowl 605 is open on the top side. Bowl 605 on upthrust side 500 may be oriented in an ESP assembly in a concave downward direction, such that bowl 605 is open on the bottom side.

Figure 6:
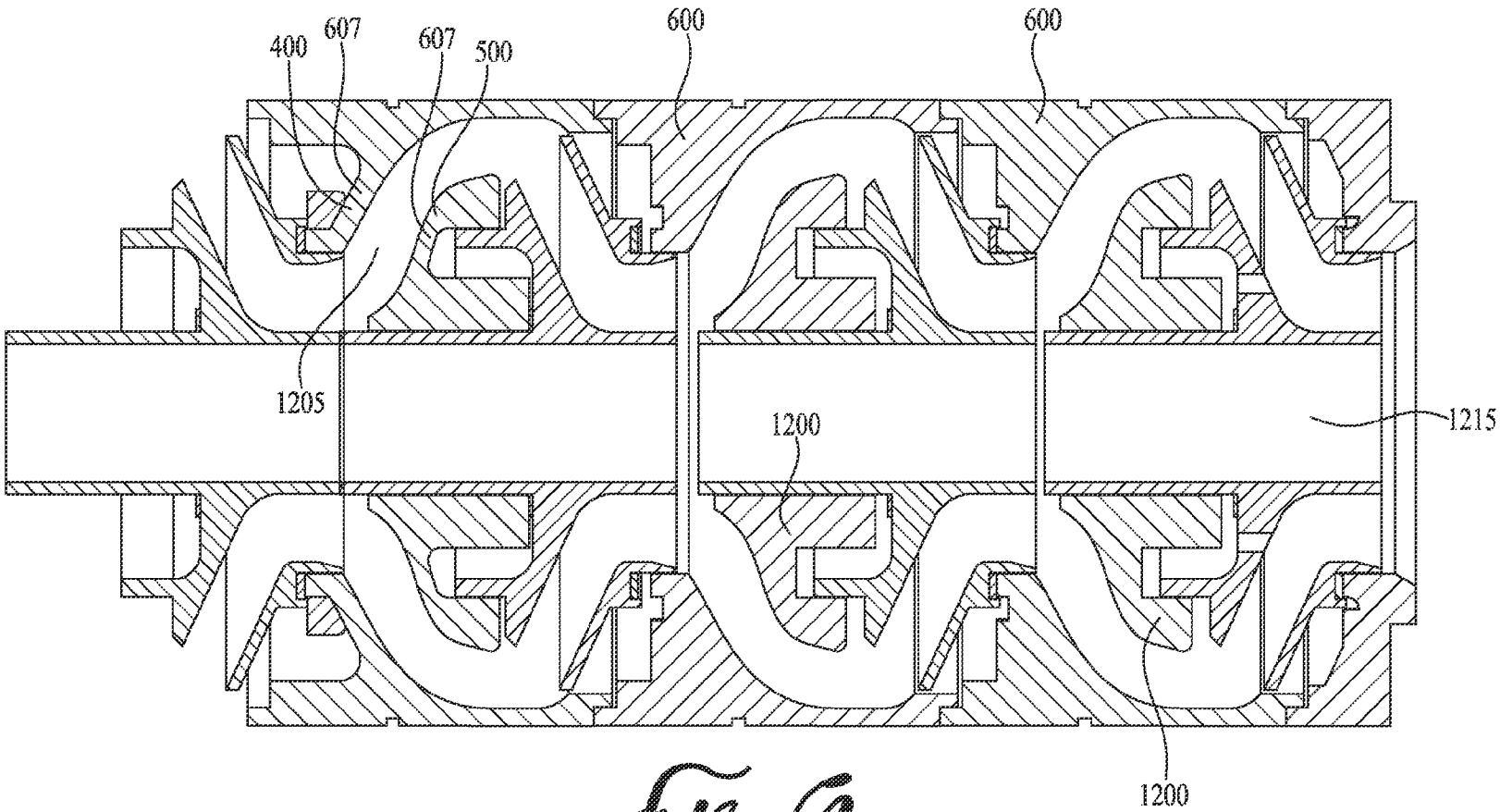
FIG. 6 is a cross sectional view of impeller and diffuser stages of an illustrative embodiment.
Figure 11A:
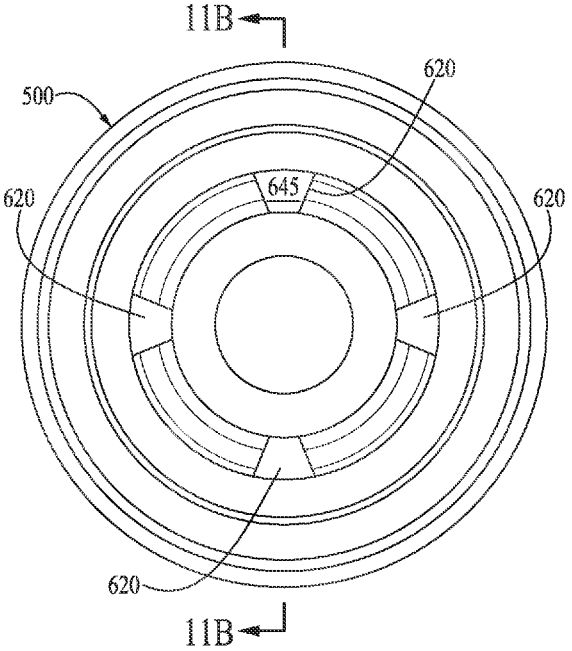
FIG. 11A is a perspective bottom view of a diffuser of an illustrative embodiment.
Figure 11B:
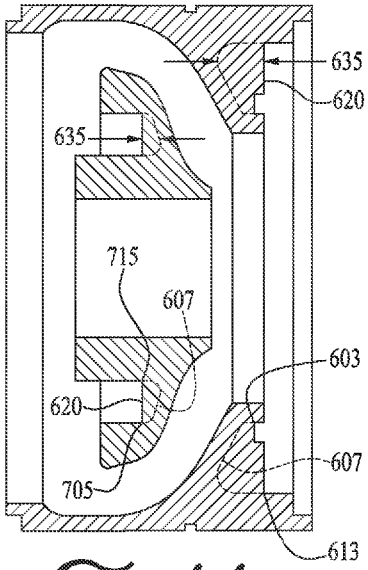
FIG. 11B is a cross sectional view across line 11B-11B of FIG. 11A of a diffuser of an illustrative embodiment.

Bowl 605 may include floor 607, which floor may be curved and/or angled as illustrated in FIG. 6. As shown in FIG. 6 and FIG. 11B, stages of impeller 1200 and diffuser 600 are shown stacked on shaft 1215. Floor 607 on upthrust side 500 of diffuser 600 may be separated from floor 607 on downthrust side 400 by diffuser vane 1205, and respective floors 607 may be may be located on opposing sides of diffuser vane 1205. Floor 607 on downthrust side 400 may be on a discharge side of diffuser 600 and floor 607 on an upthrust side 500 may be on an inlet side of diffuser 600. Bowl 605 on an upthrust side 500 may curve in a direction opposite to that of bowl 605 on downthrust side 400, and the bowls 605 may be coupled, directly attached and/or separated by diffuser vane 1205.

Returning to FIGS. 4 and 5, bowls 605 may include walls extending axially from floor 607 around both an inner diameter 615 and an outer diameter 610 of each bowl 605. On a downthrust side 400, downthrust pad 603 may extend axially downstream as a circular wall at, about, around and/or on an inner diameter 615 of bowl 605, and outer wall 613 may extend axially at, about, around and/or on an outer diameter 610 of bowl 605. On an upthrust side 500, balance ring 705 may extend axially upstream as a circular wall at, about, around and/or on outer diameter 610 of bowl 605 and upthrust pad 715 may extend axially at, about, around and/or the inner diameter 615 of bowl 605. Hub 720, which may be the inner circumference of upthrust pad 715, may surround impeller 1200 (shown in FIG. 6) of the centrifugal pump, gas separator or charge pump in which diffuser 600 is placed.

Wedge Orientation

Wedge 620 may protrude axially from floor 607 of one or more bowls 605. Height 635 (shown in FIG. 7A) of wedge 620 may extend axially in a downstream direction when in a downthrust bowl 605, and axially in an upstream direction when in an upthrust bowl 605. Wedge 620 may extend radially between inner diameter 615 and outer diameter 610 of bowl 605 and/or between the inner and outer walls of bowl 605. In some embodiments, wedge 620 may extend completely from inner diameter 615 to outer diameter 610. In such instances, wedge 620 may be integral with and/or directly attached to the inner and outer walls of bowl 605. Alternatively wedge 620 may not reach all the way to inner diameter 615 and/or downthrust pad 603 or upthrust pad 715 as applicable, and instead may begin slightly radially outward of inner diameter 615. Wedge 620 may be directly attached to, flush with, coupled to and/or integral with outer diameter 610 and/or outer wall 613 or balance ring 705, as applicable. As wedge 620 is inside bowl 605, wedge 620 may extend between the inner surface of the outer walls and the outer surface of the inner walls of bowl 605.

Wedge Geometry

Figure 7A:
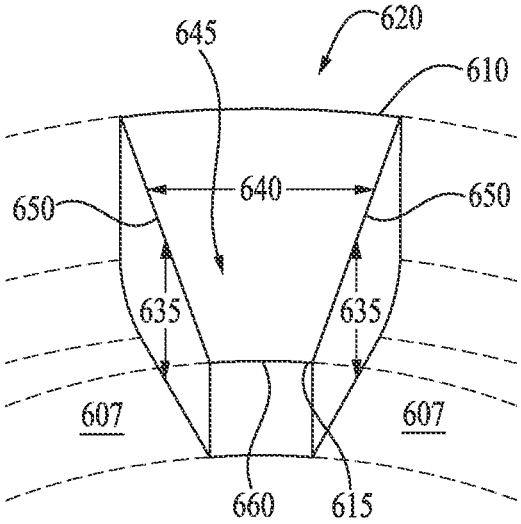
FIG. 7A is a perspective view of a blunted pie-shaped wedge of an illustrative embodiment.
Figure 12:
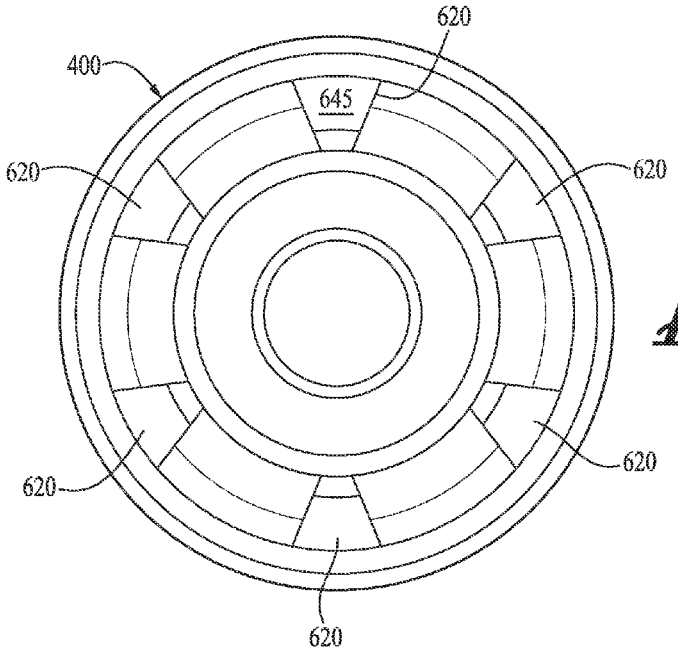
FIG. 12 illustrates a perspective view of an upthrust side of a diffuser of an illustrative embodiment.

As illustrated in FIG. 7A, wedge 620 may be a blunted pie-shaped wedge. The thickness 640 of wedge 620, as measured in a circumferential direction, may increase from inner diameter 615 to outer diameter 610 to form a pie-shaped wedge. In one example, the thickness 640 of wedge 620 may increase linearly towards outer diameter 610 such that the roof 645 of wedge 620 forms the shape of a sector of a circle, but with a blunted side 660 facing inner diameter 615 and/or downthrust pad 603 or upthrust pad 715. As shown in FIG. 7A, FIG. 11A and FIG. 12, the roof 645 of wedge 620, when viewed from above, may form the shape of a sector of a circle, such as an octant or sextant. Wedge 620 may be "blunted" since the side 660 of wedge 620 facing inner diameter 615, downthrust pad 603 and/or upthrust pad 715 may not come to a point, but may instead be flat and/or rounded, for example to follow the curve of inner diameter 615, downthrust pad 603 and/or upthrust pad 715. In sectorial embodiments, wedge 620 may be an octant or sextant or a similar shape. In certain embodiments, two radial sides 650 of each wedge may form a forty-five degree angle from one another, or about a forty-five degree angle, such as ranging between a twenty degree angle and sixty degree angle from one another. In one example, radii and/or radial sides 650 may form a thirty, forty-five or sixty degree angle from one another. In some embodiments, the circumferential thickness 640 of wedge 620 at inner diameter 615 may be about 0.25 inches in chord length. In some embodiments, the thickness 640 of wedge 620 measured in a circumferential direction may increase non-linearly such that radial sides 650 curve, but the thickness 640 of wedge 620 at outer diameter 610 will always be greater than at inner diameter 615 and/or at the innermost point of wedge 620.

Figure 7B:
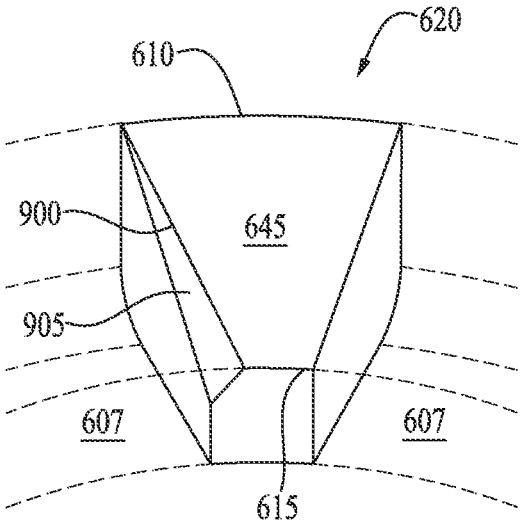
FIG. 7B is a perspective view of a chamfered pie-shaped wedge of an illustrative embodiment.
Figure 7C:
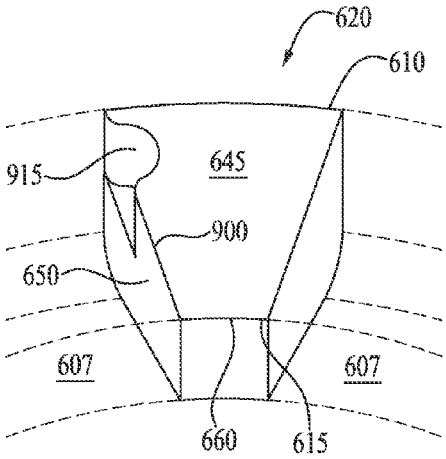
FIG. 7C is a perspective view of a funneled pie-shaped wedge of an illustrative embodiment.
Figure 8:
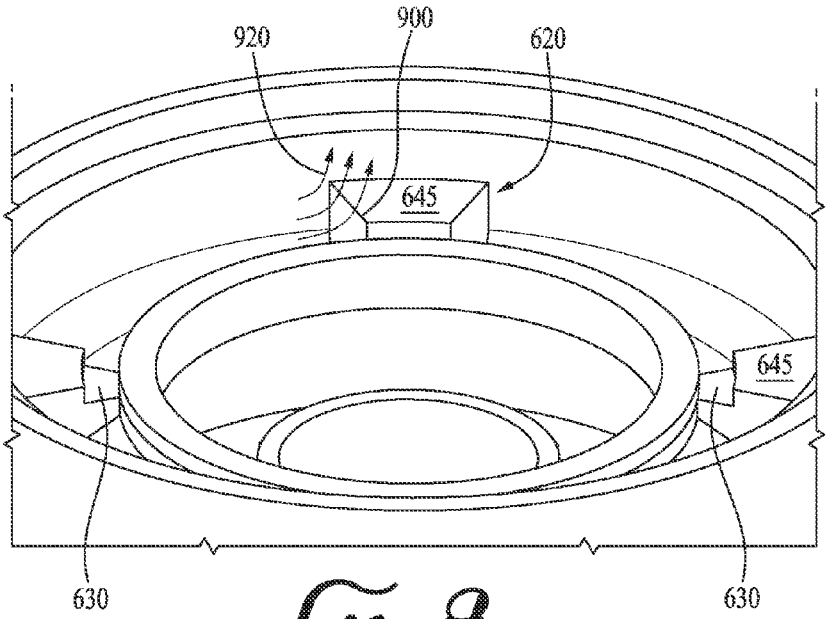
FIG. 8 is a schematic diagram of fluid flow through a diffuser of an illustrative embodiment.
Figure 13:
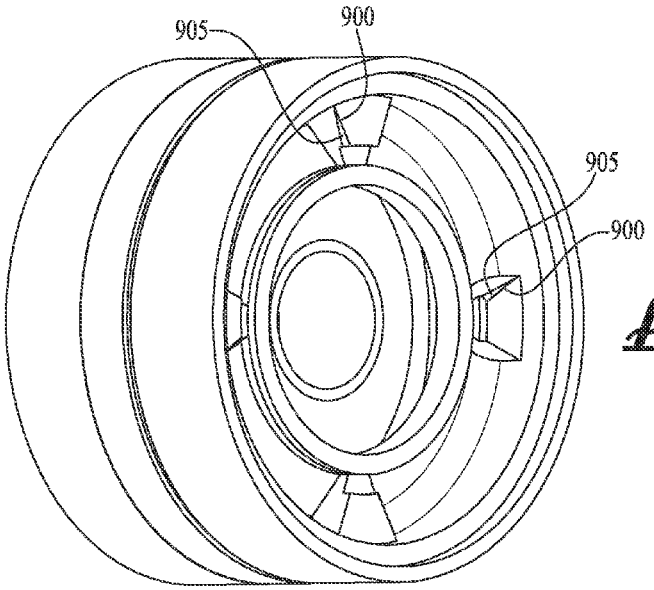
FIG. 13 is a perspective view of a diffuser with chamfered wedges of an illustrative embodiment.
Figure 14:
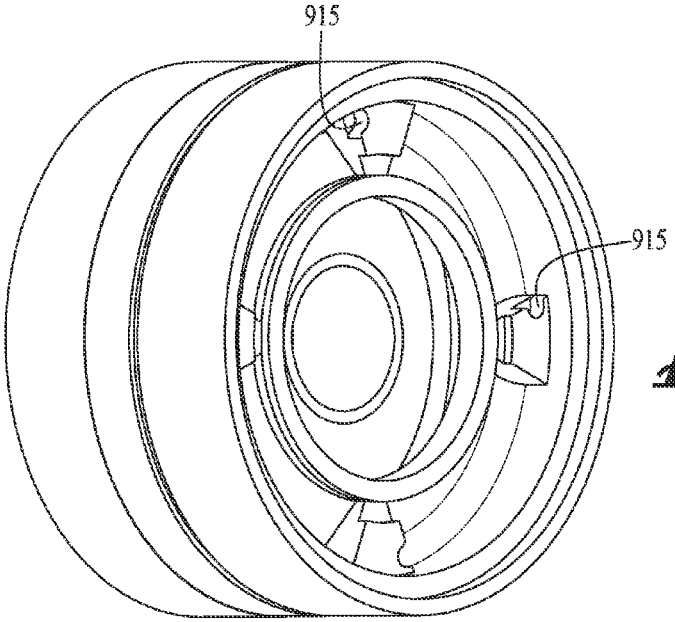
FIG. 14 is a perspective view of a diffuser with funneled wedges of an illustrative embodiment.
Figure 15:
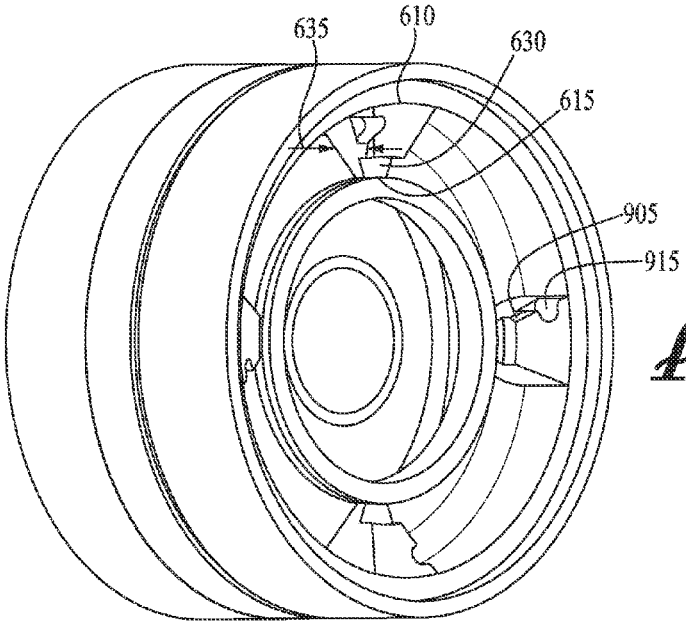
FIG. 15 is a perspective view of a diffuser with chamfered and funneled wedges of an illustrative embodiment.

Wedge 620 may include additional geometric features that may complement the blunted pie-wedge shape and/or enhance wedge 620's anti-swirl properties, such as a funnel, a chamfer or both. Wedge 620 may include a bevel or chamfer on a leading edge of roof 645. As shown in FIG. 7B, FIG. 8 and FIG. 13, leading edge 900 may be on the side of wedge 620 and/or roof 645 to first make contact with pumped solid-laden fluid 920 (shown in FIG. 8) moving through diffuser 600, and located on or immediately adjacent to roof 645. Chamfer 905 may be a sloping surface at a corner of roof 645 on leading edge 900, for example a beveled or curved corner, rather than a ninety-degree angled corner. Chamfer 905 may begin outwards of any notch 630 (shown in FIG. 8), and may be wider on an inner side than at an outer side such that it is triangular in shape with a greater surface area towards inner diameter 615. In some embodiments, chamfer 905 may be uniform in width, for example having a rectangular surface area. In another example as shown in FIG. 7C, wedge 620 may include a funneled incision on a leading edge 900 of roof 645. As shown in FIG. 7C and FIG. 14, funnel 915 may be an incision protruding into leading edge 900 and/or radial sides 650 on a leading side of wedge 620 and/or roof 645. Funnel 915 may be located on leading edge 900 of roof 645 near, proximate and/or at outer diameter 610, closer to outer diameter 610 than to inner diameter 615. Funnel 915 may be semi-circular in shape or curved like an arc to assist in directing well fluid away from the walls and floor of bowl 605. In some embodiments, the vertical edges of wedge 620 leading into funnel 915 may be filleted. FIG. 15 illustrates a wedge 620 with both a chamfer 905 and a funnel 915. Also, shown in FIG. 15 is a wedge 620 with a notch 630 and an increase in axial height 635 towards outer diameter 610 (an inclined roof 645 towards outer diameter 610 and/or outer wall 613 or balance ring 705). In some embodiments, no chamfer, notch and/or funnel is necessary.

Figure 9A:
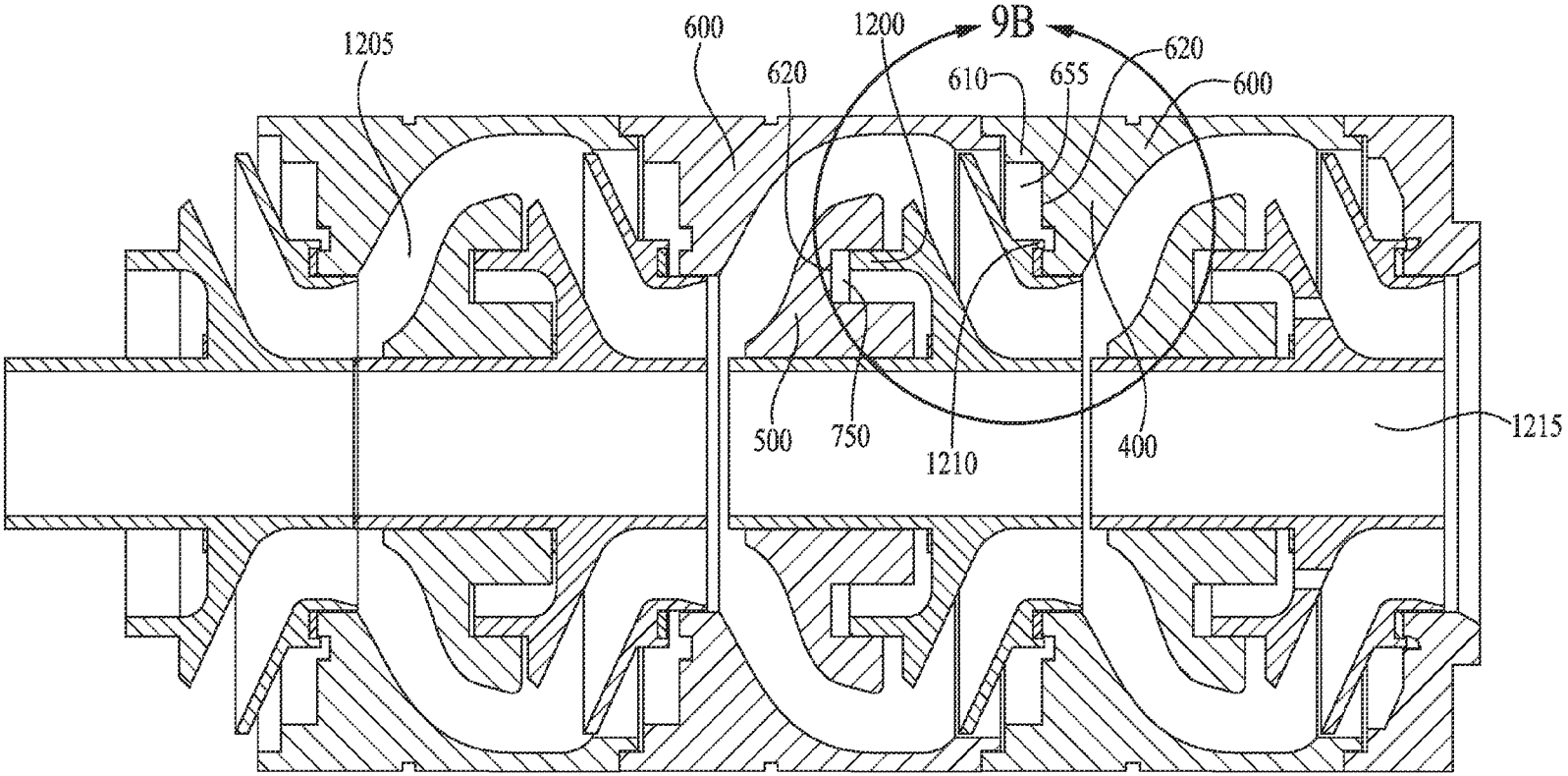
FIG. 9A is a cross sectional view of stages of an illustrative embodiment.
Figure 9B:
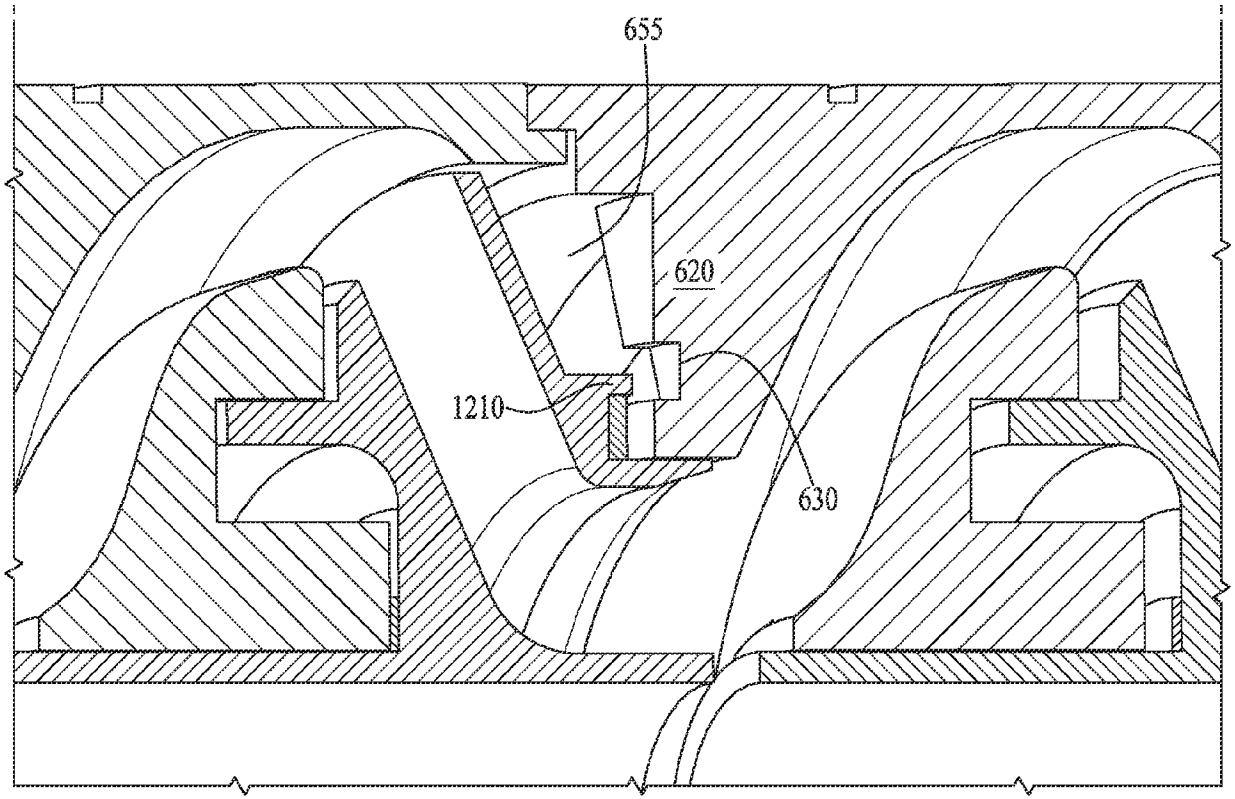
FIG. 9B is an enlarged view of the stages of FIG. 9A.

The axial height 635 of wedge 620 may depend on the dimensions of diffuser 600 and may be the greatest height possible whilst not interfering with impeller 1200 paired with diffuser 600, as illustrated in FIG. 9A. As shown in FIG. 9A and FIG. 9B, axial height 635 (shown in FIG. 7A) of wedge 620 may protrude into discharge cavity 655 formed between impeller 1200 and diffuser 600 on a downthrust side 400 of diffuser 600 and/or may protrude perpendicularly into inlet cavity 750 formed between impeller 1200 and diffuser 600 on an upthrust side 500 of diffuser 600.

Figure 10:
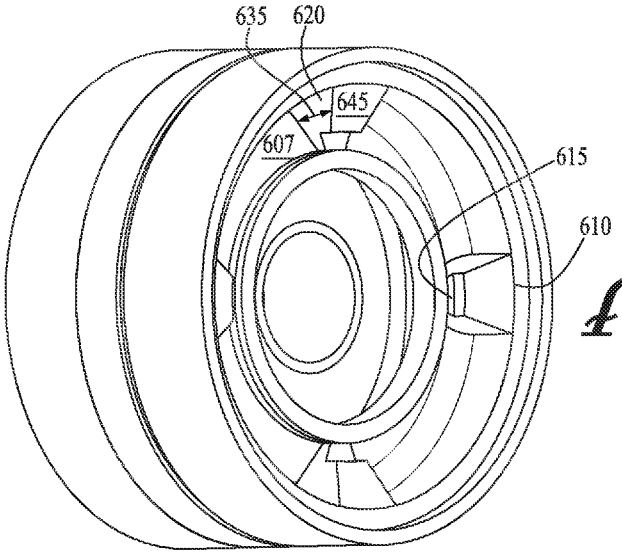
FIG. 10 is a perspective view of an illustrative embodiment of a diffuser having pie-shaped wedges with a slanted roof of an illustrative embodiment.

As shown in FIG. 10, the axial height 635 of wedge 620 may increase with the radius of the bowl 605 (towards outer diameter 610), such that the roof 645 of wedge 620 slopes upward as judged from inner diameter 615. The incline of roof 645 of wedge 620 may be greater than any decline in floor 607 such that height 635 increases towards outer diameter 610 despite a downward sloping floor 607, as judged from inner diameter 615. In such instances, wedge 620 may be tallest at outer diameter 610. In other embodiments, for example as shown in FIG. 5 the axial height 635 may be uniform with radius, or for example as shown in FIG. 11B, the axial height 635 may increase just enough to counteract the decline of floor 607, such that a flat roof 645 is formed on wedge 620. Wedge 620 may include notch 630 (shown in FIG. 4) and/or a step in axial height 635, to accommodate the paired impeller 1200 and/or provide a relief for the impeller 1200. Incorporating notch 630 may allow wedge 620 to be as tall as possible whilst not interfering with extrusion 1210 (shown in FIG. 9B) of co-axially stacked impeller 1200. In some embodiments, the axial height 635 of wedge 620 is between about 0.06 inches and about 0.25 inches as measured at outer diameter 610 axially from floor 607.

Wedge Disbursement

As illustrated in FIGS. 11A and 12, wedges 620 may be evenly spaced around floor 607 of bowl 605. FIG. 11A shows four wedges 620 evenly spaced every 90 degrees about floor 607. FIG. 12 shows six wedges 620 evenly spaced every 60 degrees about floor 607. In some embodiments, wedges 620 on a downthrust side 400 of diffuser 600 and wedges 620 on an upthrust side 500 of diffuser 600 may be about axially in-line with one another. In other embodiments, the wedges 620 may be off-set, for example, in an embodiment with four wedges 620 on an upthrust side 500 and four wedges 620 on a downthrust side 400, each downthrust wedge 620 may be offset from each upthrust wedge 620 by about 45 degrees. Wedges 620 may be cast during manufacture of diffuser 600. Embellishments such as notch 630, funneled incision 915, or chamfer 905 may be tooled, cast or machined. In some embodiments, wedge 620 may be attached to or integral with an adjoining diffuser wall, such as downthrust wall 613, downthrust pad 603, upthrust pad 715 and/or balance ring 705.

Pump Assembly Stages

As illustrated in FIG. 9A, diffuser 600 may be paired with impeller 1200 to form a stage of a centrifugal pump, gas separator or charge pump for use in an ESP assembly. The impeller may be keyed to shaft 1215 of the centrifugal pump, gas separator or charge pump and rotate with shaft 1215. Multiple stages may be employed to increase the pressure the pump exerts on produced fluid. For example, between about 120 and 273 stages of diffuser 600 and impeller 1200 pairs may be employed in a centrifugal pump of illustrative embodiments. FIG. 9A illustrates an embodiment of a cross sectional view of multiple stages of a centrifugal pump, gas separator or charge pump incorporating a diffuser 600 of illustrative embodiments. Diffusers 600 may contain wedges 620 only on an upthrust side 500, only on a downthrust side 400 or on both an upthrust or downthrust side. Whether a particular diffuser 600 in an ESP assembly component contains wedges 620 may vary from stage to stage. For example, the bottom-most diffuser in a multi-stage centrifugal pump may include only wedges 620 only on a downthrust side 400, and none on a bottom side, although other diffusers in the pump assembly may include both upthrust and downthrust wedges 620. The bottom most diffuser 600 in a multi-stage ESP pump may not experience upthrust and thus may not contain an "upthrust" side. In another example, the diffusers 600 may alternate having wedges 620 on an upthrust side 500 or a downthrust side 400.

Fluid Flow

FIG. 8 illustrates the effect that wedge 620 may have on the flow of media in well fluid. As shown in FIG. 8, the wedges 620 of illustrative embodiments may cause media in well fluid to substantially change course to join the primary flow of produced fluid away from the diffuser floor 607 and outer diffuser wall, thereby reducing abrasion on the walls and floor of the diffuser. In addition, the increased thickness 640 at the outer diameter 610 of the wedges 620 (as compared to the thickness 640 of the wedges 620 at the inner diameter 615) may reduce the likelihood that media will erode through the wedge 620 at its outer diameter 610.

Illustrative embodiments may reduce the abrasive effect of media swirling by directing media contained in produced well fluid away from the walls and floor of a diffuser bowl. Illustrative embodiments may provide a thicker barrier against abrasion at the outer diameter of a wedge and therefore may combat erosion for increased periods of time. Illustrative embodiments may therefore increase the life-span of diffusers implemented in abrasive environments, such as ESP assemblies operating in downhole wells containing abrasive media.

Thus, the invention described herein provides one or more embodiments of an abrasive handling submersible pump assembly diffuser. While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A submersible pump assembly diffuser comprising:
a diffuser bowl comprising a floor; and
a plurality of pie-shaped wedges arranged about the diffuser bowl floor, each of the plurality of pie-shaped wedges protruding axially from the diffuser bowl floor and extending radially between an inner diameter and an outer diameter of the diffuser bowl, wherein a circumferential thickness of each of the plurality of pie-shaped wedges increases from the inner diameter to the outer diameter of the diffuser bowl.

2. The submersible pump assembly diffuser of claim 1, wherein a side of each of the plurality of pie-shaped wedges facing the inner diameter of the diffuser bowl is blunted.

3. The submersible pump assembly diffuser of claim 1, wherein at least one of the plurality of pie-shaped wedges comprises a sector-shaped roof.

4. The submersible pump assembly diffuser of claim 3, wherein the roof is an octant.

5. The submersible pump assembly diffuser of claim 3, wherein the roof is inclined towards the outer diameter of the diffuser bowl as judged from the inner diameter of the diffuser bowl.

6. The submersible pump assembly diffuser of claim 5, wherein the roof comprises a notch in height.

7. The submersible pump assembly diffuser of claim 3, wherein at least one pie-shaped wedge of the plurality of pie-shaped wedges comprises a chamfer on a leading edge of the sector-shaped roof, wherein the chamfer decreases in surface area from the inner diameter to the outer diameter of the diffuser bowl.

8. The submersible pump assembly diffuser of claim 3, wherein the roof is flat between the inner diameter and the outer diameter of the diffuser bowl.

9. The submersible pump assembly diffuser of claim 3, wherein the roof comprises a funneled incision on a leading edge.

10. The submersible pump assembly diffuser of claim 9, wherein the roof comprises a chamfer on the leading edge.

11. The submersible pump assembly diffuser of claim 1, wherein there are four pie-shaped wedges in the plurality of pie-shaped wedges evenly spaced about the diffuser bowl floor.

12. The submersible pump assembly diffuser of claim 1, wherein the diffuser bowl is one of an upthrust bowl or a downthrust bowl.

13. The submersible pump assembly diffuser of claim 1, wherein each of the plurality of pie-shaped wedges comprises a slanted roof.

14. The submersible pump assembly diffuser of claim 1, wherein each of the plurality of pie shaped wedges comprises two radial sides separated by about a forty-five degree angle.

15. The submersible pump assembly diffuser of claim 1, wherein the diffuser bowl is in a stage of an electric submersible pump assembly gas separator.

16. The submersible pump assembly diffuser of claim 1, wherein the diffuser bowl is in a stage of an electric submersible pump assembly charge pump.

17. The submersible pump assembly diffuser of claim 1, wherein the diffuser bowl is in a stage of a centrifugal pump of an electric submersible pump assembly.

18. The submersible pump assembly diffuser of claim 1, wherein the circumferential thickness of each of the plurality of pie-shaped wedges increases linearly from the inner diameter to the outer diameter of the diffuser bowl.

19. A pump assembly stage comprising:

a rotatable impeller; and a co-axially mounted diffuser comprising:

a diffuser bowl comprising a plurality of diffuser bowl wedges having a pie-shape, each of the plurality of diffuser bowl wedges protruding axially from a diffuser bowl floor into a cavity between the rotatable impeller and the co-axially mounted diffuser such that each of the plurality of diffuser bowl wedges protrudes into a path of pumped fluid, wherein each of the plurality of pie-shaped wedges extends radially between an inner wall and an outer wall of the diffuser bowl and a thickness in a circumferential direction of each of the plurality of the pie-shaped wedges increases towards the outer wall.

20. The pump assembly stage of claim 19, wherein each of the plurality of diffuser bowl wedges has a blunted side facing the inner wall.

21. The pump assembly stage of claim 19, wherein a top side of at least one of the plurality of diffuser bowl wedges forms an inclined roof as judged from the inner wall.

22. The pump assembly stage of claim 19, wherein each of the plurality of diffuser bowl wedges comprises a chamfer on a leading edge.

23. The pump assembly stage of claim 19, wherein each of the plurality of diffuser bowl wedges comprises a funneled incision on a leading edge.

24. The pump assembly stage of claim 19, wherein the cavity is on an inlet side of the co-axially mounted diffuser.

25. The pump assembly stage of claim 19, wherein the cavity is on a discharge side of the co-axially mounted diffuser.

* * * * *